US007873297B2

(12) United States Patent
Andoh et al.

(10) Patent No.: US 7,873,297 B2
(45) Date of Patent: Jan. 18, 2011

(54) IMAGE FORMING APPARATUS

(75) Inventors: Takayuki Andoh, Kanagawa (JP); Takamasa Shiraki, Kanagawa (JP); Masahiko Yamada, Tokyo (JP); Takeshi Washio, Kanagawa (JP); Hiroshi Ishii, Kanagawa (JP); Kazushige Kawamura, Kanagawa (JP); Keisuke Shimizu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 822 days.

(21) Appl. No.: 11/878,065

(22) Filed: Jul. 20, 2007

(65) Prior Publication Data

US 2008/0025751 A1 Jan. 31, 2008

(30) Foreign Application Priority Data

Jul. 31, 2006 (JP) ..... 2006-209281
May 18, 2007 (JP) ..... 2007-133365

(51) Int. Cl.
*G03G 21/20* (2006.01)

(52) U.S. Cl. ..... 399/94; 399/96

(58) Field of Classification Search ..... 399/94, 399/96, 97, 70

See application file for complete search history.

(56) References Cited

U.S. PATENT DOCUMENTS 4,367,036 A * 1/1983 Sakamaki et al. ..... 399/96
6,647,223 B2 11/2003 Ishii
6,687,474 B2 2/2004 Yamada et al.
6,898,407 B2 5/2005 Noguchi et al.
6,937,838 B2 8/2005 Ishii et al.
6,970,665 B2 11/2005 Kuma et al.
7,016,629 B2 3/2006 Ishii et al.
7,164,874 B2 1/2007 Kuma et al.
7,174,121 B2 2/2007 Kuma et al.
7,181,152 B2 2/2007 Kuma et al.
7,184,684 B2 2/2007 Murakami et al.
2004/0223790 A1 11/2004 Hosokawa et al.
2005/0084293 A1 4/2005 Fukuchi et al.
2005/0169653 A1 8/2005 Noguchi et al.
2005/0281594 A1 12/2005 Kuma et al.
2006/0083555 A1 4/2006 Uchiyama et al.
2006/0116065 A1 6/2006 Ishii (Continued)

FOREIGN PATENT DOCUMENTS

JP 2001-209296 8/2001

(Continued)

OTHER PUBLICATIONS

Chinese Office Action and English Translation dated Dec. 5, 2008.

*Primary Examiner*—David M Gray
*Assistant Examiner*—Laura K Roth
(74) *Attorney, Agent, or Firm*—Harness, Dickey & Pierce, P.L.C.

(57) ABSTRACT

An image forming apparatus includes an imaging unit for black and imaging units for other colors, a writing unit for black and a writing unit for other colors, a first heater corresponding to the imaging unit and the writing unit for black color, and a second heater corresponding to the imaging units and the writing unit for other colors. Turning ON/OFF of each of the first heater and the second heater are controlled separately. Thus, the first heater can be ON while the second heater is OFF.

19 Claims, 9 Drawing Sheets

U.S. PATENT DOCUMENTS

| | | | |
|---|---|---|---|
| 2006/0120763 | A1 | 6/2006 | Ishii et al. |
| 2006/0140659 | A1 | 6/2006 | Washio et al. |
| 2006/0280530 | A1 | 12/2006 | Andoh |
| 2007/0059036 | A1 | 3/2007 | Yamada et al. |

FOREIGN PATENT DOCUMENTS

| | | | | |
|---|---|---|---|---|
| JP | 2001209296 | A | * | 8/2001 |
| JP | 2002-215006 | | | 7/2002 |
| JP | 2002215006 | A | * | 7/2002 |
| JP | 2004-061580 | | | 2/2004 |
| JP | 2005338576 | A | * | 12/2005 |

* cited by examiner

| TEMPERATURE SENSOR | REQUIRED TIME UNTIL Ts |
|---|---|
| 0 TO T1 | t0 |
| T1 TO T2 | t1 |
| T2 TO T3 | t2 |
| T3 TO T4 | t3 |
| T4 TO T5 | t4 |
| T5 TO T6 | t5 |

| MONTH/DAY | ts |
|---|---|
| April 2 | 8:00 |
| April 3 | 9:30 |
| ⋮ | ⋮ |
| April 7 | 10:00 |

IMAGE FORMING APPARATUS

CROSS-REFERENCE TO RELATED APPLICATIONS

The present application claims priority to and incorporates by reference the entire contents of Japanese priority documents, 2006-209281 filed in Japan on Jul. 31, 2006 and 2007-133365 filed in Japan on May 18, 2007.

BACKGROUND OF THE INVENTION

1. Field of the Invention

The present invention relates to a technology for preventing an occurrence of dew condensation in an image forming apparatus.

2. Description of the Related Art

In a tandem-type image forming apparatus including a photoconductor and a writing unit, when a temperature inside the image forming apparatus rises rapidly from a low temperature, dew condensation may occur on the photoconductor or the writing unit. It is known that an occurrence of dew condensation can be prevented by heating an image forming unit.

For heating an image forming unit to prevent an occurrence of dew condensation, Japanese Patent Application Laid-open No. 2002-215006 discloses a technique for reducing power consumption of a heater by turning on the heater when a predetermined period of time elapsed after a fixing unit is shifted to an energy-saving mode. Furthermore, Japanese Patent Application Laid-open No. 2004-61580 discloses a technique for using exhaust heat of the fixing unit for a heater for preventing an occurrence of dew condensation.

However, if toner cartridges of all colors, i.e., BK (Black), M (Magenta), C (Cyan), and Y (Yellow), are heated during night time or holidays, i.e., when the image forming apparatus is not frequently used, it is problematic that the power consumption of the heater considerably increases. Therefore, it is required to reduce the power consumption during night time or holidays.

SUMMARY OF THE INVENTION

It is an object of the present invention to at least partially solve the problems in the conventional technology.

According to an aspect of the present invention, there is provided an image forming apparatus including a plurality of writing units, each of the writing units configured to write an optical image on a corresponding one of an image carrier; a plurality of image forming units, each of the image forming units configured to develop an optical image on a corresponding one of the image carrier to a visible image in a corresponding color; a plurality of heaters configured to heat one or more of the image forming units and the writing units to prevent occurrence of dew condensation; and a control unit configured to perform ON/OFF control of each of the heaters.

According to another aspect of the present invention, there is provided an image forming apparatus including a plurality of writing units, each of the writing units configured to write an optical image on a corresponding one of an image carrier; a plurality of image forming units, each of the image forming units configured to develop an optical image on a corresponding one of the image carrier to a visible image in a corresponding color; a plurality of heaters configured to heat one or more of the image forming units and the writing units to prevent occurrence of dew condensation; and a control unit configured to perform ON/OFF control of each of the heaters, wherein the heaters include a first heater configured to heat one of the image forming units and corresponding one of the writing units; and a second heater configured to heat the image forming units and the writing units other than the image forming unit and the writing unit heated by the first heater, and the control unit separately perform ON/OFF control of each of the first heater and the second heater.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
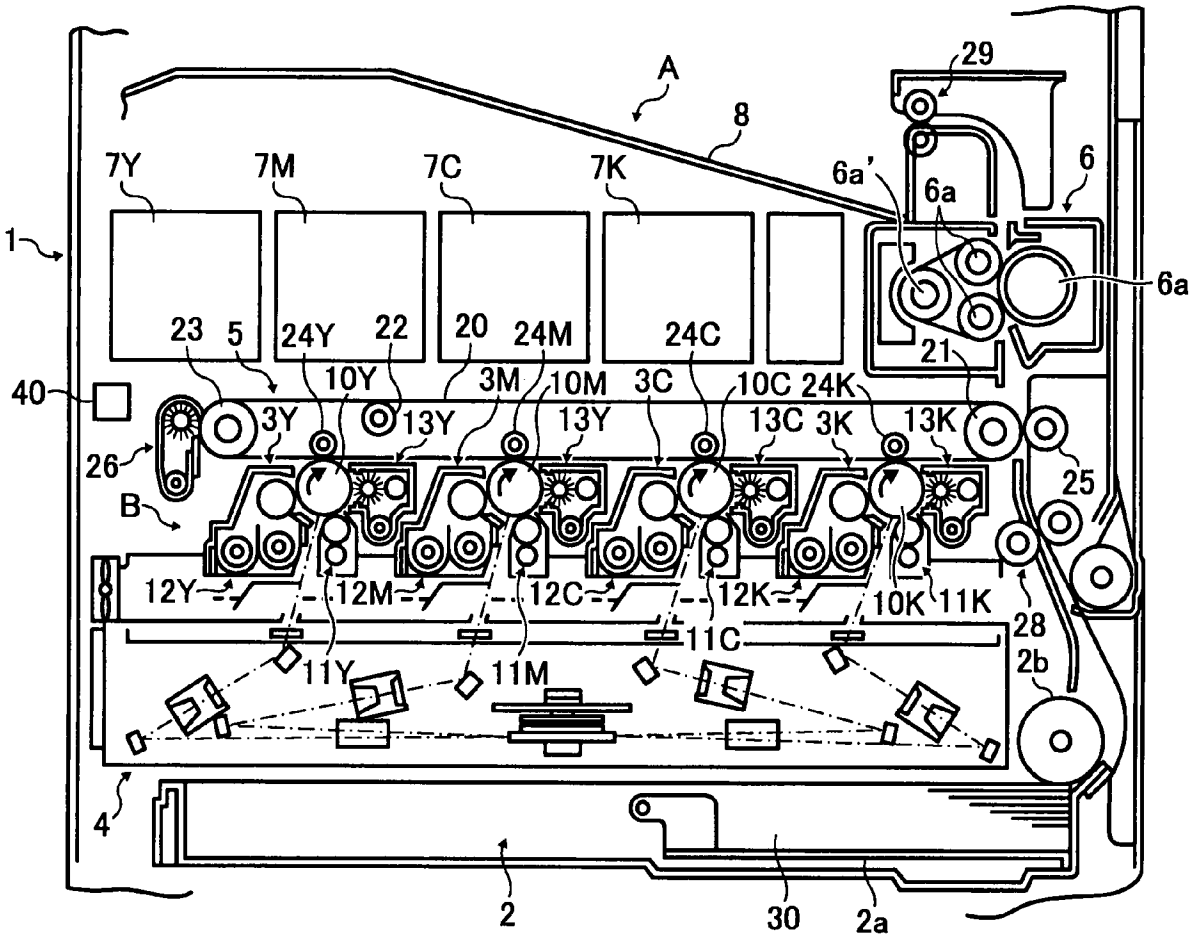
FIG. 1 is a schematic diagram of a tandem-type image forming apparatus according to an embodiment of the present invention.
Figure 2:
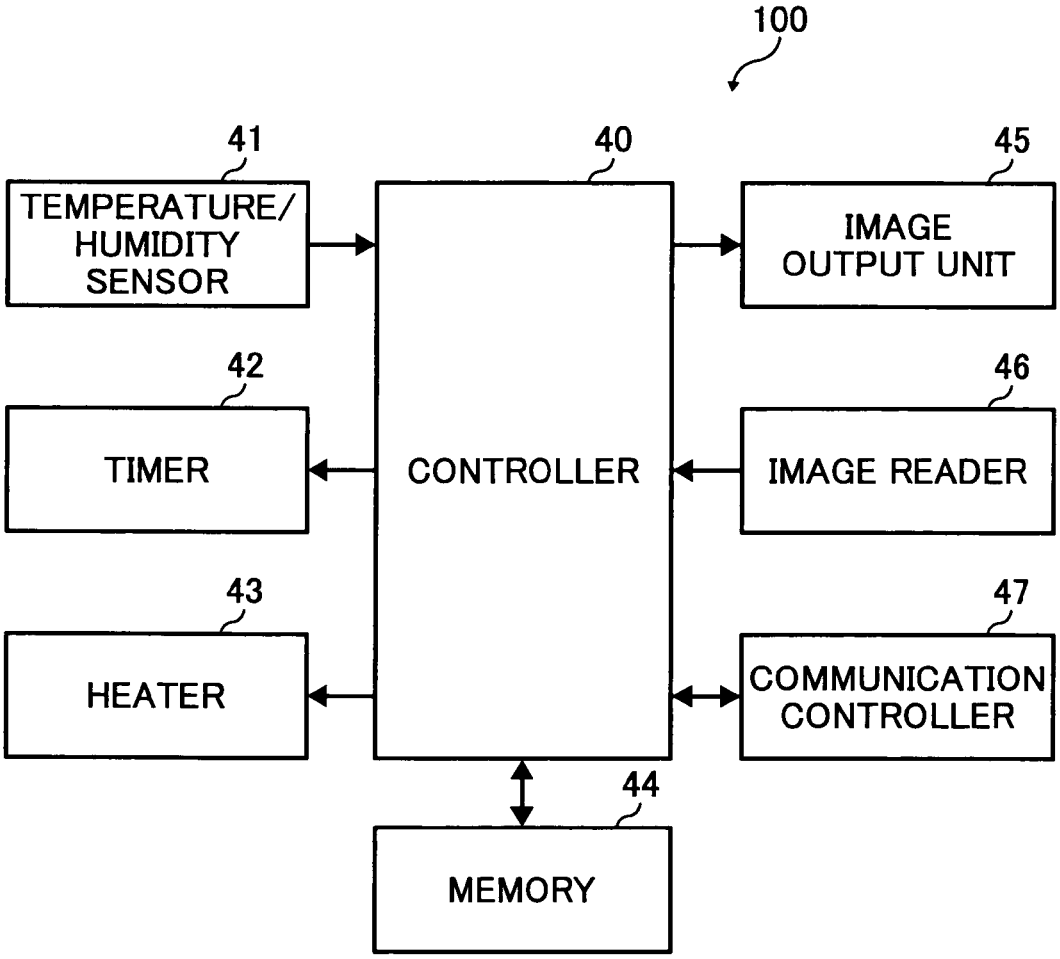
FIG. 2 is a block diagram of a control system in the image forming apparatus shown in FIG. 1.

Exemplary embodiments of the present invention are explained in detail below with reference to the accompanying drawings. FIG. 1 is a schematic diagram of a tandem-type image forming apparatus A according to an embodiment of the present invention. FIG. 2 is a block diagram of a control system in the image forming apparatus A.

A dew-condensation preventing unit (dew-condensation preventing device) according to the embodiment is explained below with reference to accompanying drawings.

As shown in FIG. 1, the image forming apparatus A is a multifunction product including at least a printer function and a facsimile function.

The image forming apparatus A includes an apparatus body 1 and a paper feeder 2. The paper feeder 2 includes a paper feeding cassette 2*a* and a paper feeding roller 2*b*, is arranged below the apparatus body 1 to store therein transfer papers P, and feeds the transfer papers P one by one.

An image forming unit B including a plurality of imaging units is arranged at the center of the apparatus body 1. An optical writing unit 4 is arranged below the image forming unit B, and an intermediate transfer belt (intermediate transfer body) 20 is arranged above the image forming unit B. A dew-condensation preventing device (a dew-condensation preventing heater unit) 30 that prevents an occurrence of dew condensation on photoconductors, which constitute imaging units, and writing units, a scanner unit (not shown), and a controller 40 that controls above units are arranged in each appropriate position in the apparatus body 1.

The image forming unit B has a yellow imaging unit 3Y, a magenta imaging unit 3M, a cyan imaging unit 3C, and a black imaging unit 3K for forming toner images of respective colors of yellow (Y), magenta (M), cyan (C), and black (B), and each of the imaging units is removably arranged in the apparatus body 1. Respective sign subscripts Y, M, C, and K indicate that a member is for yellow, magenta, cyan, and black, respectively.

Each of the imaging units 3Y, 3M, 3C, 3K includes each of drum-type photoconductors (image carriers) 10Y, 10M, 10C, 10K as latent image carriers, which rotate in a direction indicated by an arrow shown in FIG. 1. Each of the photoconductors 10Y, 10M, 10C, 10K include a cylindrical base made of aluminum, and an organic photoconductor (OPC) photosensitive layer that covers the surface of the cylindrical base. Each of the imaging units 3Y, 3M, 3C, 3K include each of chargers 11Y, 11M, 11C, 11K that charge the photoconductors, developing apparatuses 12Y, 12M, 12C, 12K as developing units that develop latent images formed on the photoconductors, and cleaners 13Y, 13M, 13C, 13K for cleaning residual toner on the photoconductors, around the photoconductors 10Y, 10M, 10C, 10K. The writing unit 4 that is an optical scanner capable of irradiating a write beam L to the photoconductors 10Y, 10M, 10C, 10K is provided below the imaging units 3Y, 3M, 3C, and 3K. An intermediate transfer unit 5 including the intermediate transfer belt 20, onto which toner images formed by the imaging units 3Y, 3M, 3C, and 3K are transferred, is provided above the imaging units 3Y, 3M, 3C, and 3K. A fixing unit 6 that fixes the toner images transferred onto the intermediate transfer belt 20 on the transfer paper P as a recording material is provided.

Toner bottles 7Y, 7M, 7C, and 7K for storing therein color toners of yellow (Y), magenta (M), cyan (C), and black (B) are loaded above the intermediate transfer unit 5 in the apparatus body 1.

The writing unit 4 deflects write beams L emitted from a laser diode as a light source by a polygon mirror as a deflecting/scanning unit, and irradiates the write beams L onto the photoconductors 10Y, 10M, 10C, and 10K. Thus, a latent image is formed on each of the photoconductors 10Y, 10M, 10C, and 10K.

The intermediate transfer belt 20 in the intermediate transfer unit 5 is extended over a drive roller 21, a tension roller 22, and a driven roller 23, and is driven to rotate in a counterclockwise direction in the diagram shown in FIG. 1 at a predetermined timing. The intermediate transfer unit 5 includes primary transfer rollers 24Y, 24M, 24C, and 24K for transferring the toner images formed on the photoconductors 10Y, 10M, 10C, and 10K onto the intermediate transfer belt 20.

The intermediate transfer unit 5 includes a secondary transfer roller 25 for transferring the toner images transferred onto the intermediate transfer belt 20 onto the transfer paper P, and a belt cleaner 26 that cleans residual toner on the intermediate transfer belt 20, which are not transferred onto the transfer paper P.

The writing unit 4 accommodates various optical parts, such as a polygon mirror, a lens, and a mirror, in a casing. The writing unit 4 includes an optical part group (glass plate, mirror, lens, and the like) constituting four-system optical paths for the four imaging units 3Y, 3M, 3C, and 3K, as well as a single semiconductor laser and a single polygon mirror commonly used for exposing photoconductors constituting the imaging units. Therefore, when dew condensation occurs on any one of the optical parts, the image quality of the image written on the respective photoconductors is degraded.

A process for obtaining a color image in the image forming apparatus having the above configuration is explained next.

In the imaging units 3Y, 3M, 3C, and 3K, the photoconductors 10Y, 10M, 10C, 10K are uniformly charged by the charger 11Y, 11M, 11C, 11K, respectively. Thereafter, the writing unit 4 deflects the write beam L based on image data, to form a latent image on the surface of the photoconductors 10Y, 10M, 10C, 10K. The latent image on the photoconductors 10Y, 10M, 10C, 10K are respectively developed by color toners carried on developing rollers (not shown) in the developing apparatuses 12Y, 12M, 12C, 12K, to form a toner image.

The toner images on the photoconductors 10Y, 10M, 10C, and 10K are sequentially superposed and transferred onto the intermediate transfer belt 20, which is rotating in a counterclockwise direction due to the action of the primary transfer rollers 25Y, 24M, 24C, and 24K. The imaging operation for each color is executed with the timing being shifted from an upstream side to a downstream side in a moving direction of the intermediate transfer belt 20, so that the toner images are superposed and transferred on the same position on the intermediate transfer belt 20. Each surface of the photoconductors 10Y, 10M, 10C, 10K is cleaned, after the primary transfer, by a cleaning brush in each of the cleaners 13Y, 13M, 13C, 13K, to make the photoconductors 10Y, 10M, 10C, 10K ready for the next image formation.

Toners filled in the toner bottles 7Y, 7M, 7C, 7K are respectively supplied, with a predetermined amount, to the developing apparatuses 12Y, 12M, 12C, 12K in the imaging units 3Y, 3M, 3C, 3K via a carrier route (not shown), if required.

On the other hand, the transfer paper P in the paper feeding cassette 2*a* is fed into the apparatus body 1 by the paper feeding roller 2*b* arranged near the paper feeding cassette 2*a*, and fed to a secondary transfer unit at a predetermined timing by a registration roller pair 28. In the secondary transfer unit, the toner image formed on the intermediate transfer belt 20 is transferred onto the transfer paper P. The transfer paper P onto which the toner image is transferred passes through the fixing unit 6 so that the toner image is fixed on the transfer paper P, and ejected to a paper ejection tray 8 by an ejection roller 29. The transfer residual toner left on the intermediate transfer belt 20 is cleaned by the belt cleaner 26, which is brought into contact with the intermediate transfer belt 20, in the same manner as that for cleaning residual toners left on the photoconductors 10Y, 10M, 10C, and 10K.

The fixing unit 6 includes a heating roller 6*a* heated by a fixing unit heater 6*a*', and a pressure roller 6*b*.

FIG. 2 is a block diagram of a control system 100 in the image forming apparatus A. The control system 100 includes the controller 40, a temperature/humidity sensor 41 that detects an external temperature and humidity of the image forming apparatus A, a timer 42 that measures a job start time and a target time for performing an operation, a heater 43 that sets the temperature to a predetermined temperature so that dew condensation hardly occurs on the required units, such as the image forming unit, a memory 44 that stores therein a first table containing an outside air temperature and a required time until the temperature of the heater 43 reaches a target value, in an associated manner, and a second table containing a date and the job start time, in an associated manner, an image output unit 45 including a laser optical system and the image forming unit, such as a printer, an image reader 46 including a scanner or the like, and a communication controller 47, such as a facsimile machine, that connects to a circuit to communicate with an external facsimile machine and multifunction product by a predetermined protocol. The image output unit 45, the image reader 46, and the communication controller 47 constitute the facsimile function, and the image output unit 45 constitutes the printer function.

In the image forming apparatus A, if inside of the image forming apparatus A is rapidly heated from a low-temperature state to a high-temperature state due to a heat from a heater, dew condensation occurs on the photoconductor and the writing unit. This is because, if the temperature inside the image forming apparatus A rapidly rises when the temperature of the parts group constituting the photoconductor and the writing unit is low due to a low outside air temperature, vapor in the air is saturated, causing dew condensation on the photoconductor and the writing unit. Because image turbulence occurs if dew condensation occurs on the photoconductor and the writing unit, it is necessary to take such a countermeasure for preventing an occurrence of dew condensation by to continuously heating the photoconductors and the writing unit 4 by the heater provided as the dew-condensation preventing device 30 during night time.

Figure 3:
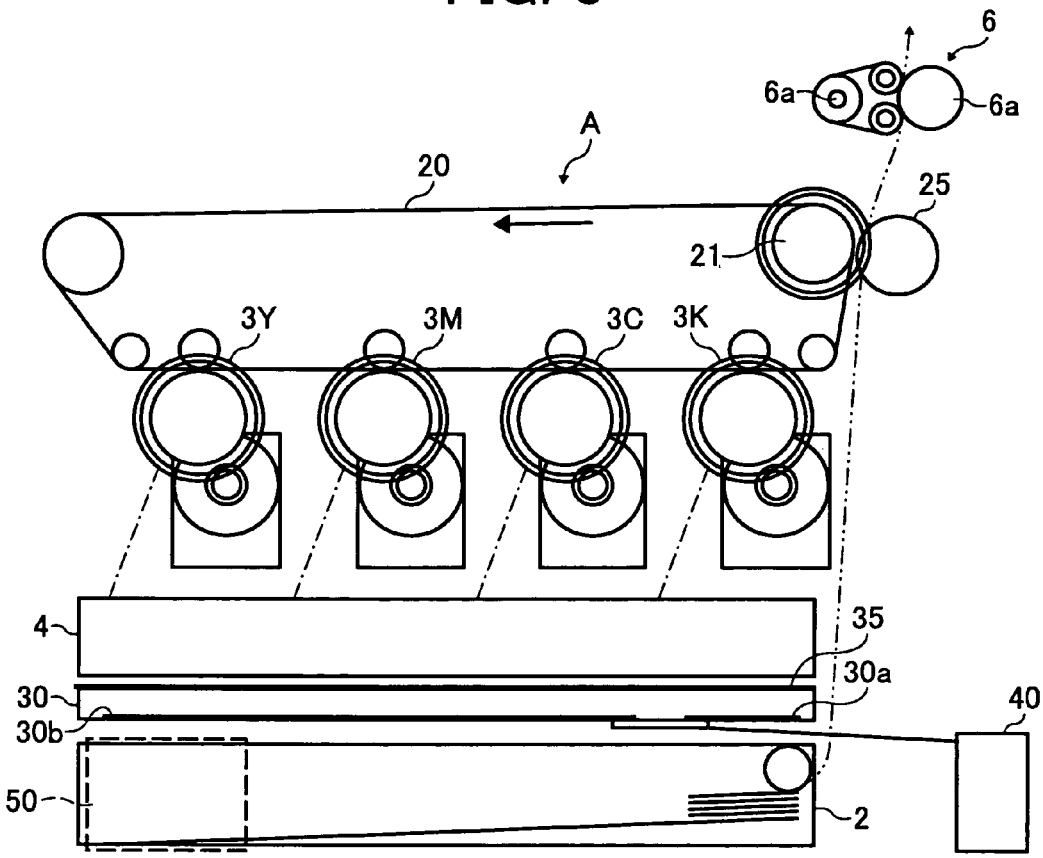
FIG. 3 is a side view of a dew-condensation preventing device arranged right under a writing unit of the image forming apparatus shown in FIG. 1.

FIG. 3 is a side view of the dew-condensation preventing device 30 arranged right under the writing unit 4. The dew-condensation preventing heaters constituting the dew-condensation preventing device 30 can be arranged not only below the writing unit 4, but also between an arrangement area of respective imaging units and the writing unit 4. Although not shown in the drawings, if the writing unit 4 is arranged above the arrangement area of respective imaging units, the dew-condensation preventing device 30 can be arranged between the imaging units and the writing unit 4.

It is preferable to arrange the dew-condensation preventing device 30 at corresponding positions below the corresponding imaging units 3Y, 3M, 3C, 3K arranged sequentially in a lateral direction, over the whole length of the image forming unit B, to cover the imaging units 3Y, 3M, 3C, 3K. Heat from the dew-condensation preventing heater constituting the dew-condensation preventing device 30 flows upwards. At this time, air, respective parts, and a sheet metal effectively act as a heat conducting medium.

When a waste toner container 50 is arranged, described by a broken line shown in FIG. 3, using a lateral space of the paper feeding cassette 2*a*, the dew-condensation preventing device 30 is overlapped on the Waste toner container 50, and a heat insulator layer is arranged between the dew-condensation preventing device 30 and the waste toner container 50, to prevent a problem such that the waste toner (having solidification temperature of about 45° C.) in the waste toner container 50 is solidified due to the heat from the dew-condensation preventing device 30 (heating temperature of the heater is about 50° C.). Alternatively, the end of the dew-condensation preventing device 30 overlapping on the waste toner container 50 can be removed.

The dew-condensation preventing device 30 heats the respective imaging units as well as the optical parts (a glass plate for partition, a mirror, a lens, and the like) of the writing unit 4, which are arranged in a position vertical to corresponding imaging units, to prevent dew condensation on the optical parts.

Dew condensation is a phenomenon in which the air including water vapor is cooled to a dew condensation point, and moisture in the air appears as drops of water. Due to the dew condensation occurring on the surface of the photoconductor constituting the imaging unit and the optical parts constituting the writing unit 4 inside the image forming apparatus, the image quality is degraded.

According to the embodiment, to prevent a specific imaging unit (e.g., the black imaging unit) and the writing unit 4 frequently operated during night time or the like from being cooled to the dew condensation point when a room temperature where the image forming apparatus is installed decreases to the dew condensation point during night time or holidays, the dew-condensation preventing heater constituting the dew-condensation preventing device 30 is controlled to be turned ON when the fixing unit heater 6*a*' constituting the fixing unit 6 is turned OFF to be in a sleep mode.

If all the Bk, M, C, and Y photoconductors and the all writing units are to be heated uniformly regardless of the operation frequency during night time or the like, the size of the dew-condensation preventing heater becomes considerably large, increasing the power consumption.

However, because only the facsimile receiving function is frequently used and other functions are hardly used during night time or holidays, there is generally little problem as far as the black images or other monochrome images for the facsimile are normally obtained. According to the embodiment, the dew-condensation preventing heater in the dew-condensation preventing device 30 is divided into at least two parts (separately provided for the black imaging unit 3K and for the other-color imaging units 3C, 3M, and 3Y), so that only the black imaging unit 3K and corresponding partial parts of the writing unit 4 are heated to prevent dew condensation. Thus, the power consumption can be suppressed to the necessity minimum.

Figure 4:
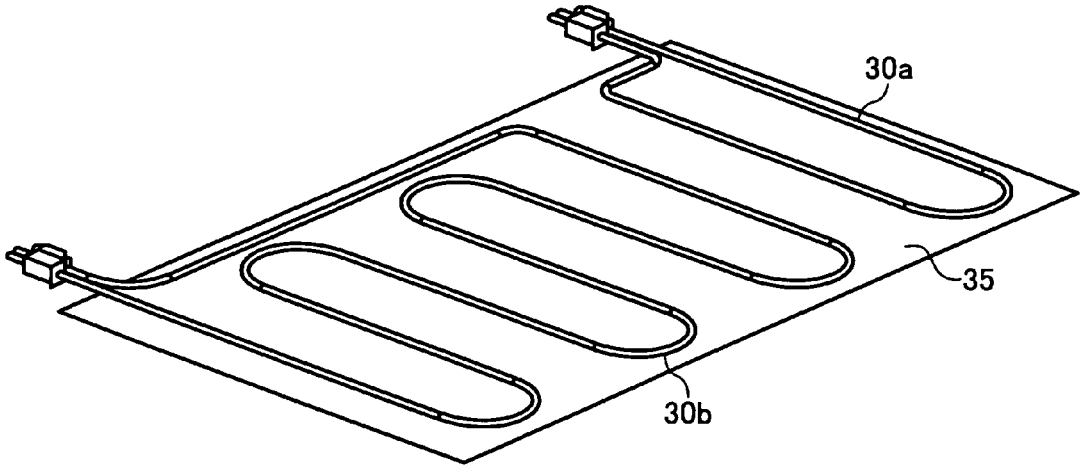
FIG. 4 is a schematic diagram of a dew-condensation preventing heater including a heater for a black imaging unit and a heater for other-color imaging units, according to the embodiment.

FIG. 4 is a schematic diagram of the dew-condensation preventing heater in the dew-condensation preventing device 30, which is divided into a heater 30*a* for the black imaging unit and a color imaging heater 30*b* for colors other than black, each being separately turned ON and OFF. Each of the heaters 30*a* and 30*b* are formed of, for example, nichrome wire, and wired on the heat insulator layer provided on one side of a sheet metal 35.

It is possible to separately arrange heaters for each of imaging units for colors other than black, i.e., for each of the color imaging units 3C, 3M, 3Y, in addition to the heater 30*a* arranged exclusively for the black imaging unit 3K. Thus, turning-ON of the heater 30*a* and the heater 30*b* can be controlled separately.

The heater 30*a* for heating the black imaging unit 3K and a corresponding constituent of the writing unit 4 (writing unit corresponding to the black imaging unit 3K) to an appropriate temperature is set to be turned ON when the fixing unit heater 6*a*' is in a power saving mode and the heater lamp is turned OFF. Even when the room temperature is low such as during night time or holidays, the heater 30*a* for the black imaging unit 3K can heat the black imaging unit 3K (a facsimile imaging unit) and the corresponding writing unit to a temperature higher than the dew condensation point at all times. Therefore, dew condensation can be prevented all the time in the black image and other monochrome images for facsimile, making it possible to use the facsimile machine at all times.

As described above, to prevent turbulence in the facsimile image due to dew condensation on the black imaging unit (the facsimile imaging unit) during night time or holidays, the heater for the black imaging unit is turned ON by shifting the fixing unit heater to the energy saving mode. Therefore, it is possible to prevent an occurrence of dew condensation on the black imaging unit and other facsimile imaging unit during night time or holidays.

On the other hand, the heater 30*b* for the color imaging units (imaging units 3C, 3M, and 3Y other than the black imaging unit 3K) is turned OFF when the copying machine or the printer is not used during night time or holidays. In this state, however, when the room temperature is low early in the morning, and the room temperature is rapidly raised, dew condensation occurs on the imaging units 3C, 3M, and 3Y.

As a measure for preventing such dew condensation, the controller 40 includes a time detecting unit that detects time for turning ON the heater 30*b* for the color imaging units several hours before the user starts to use the copying machine or the printer. Thus, the imaging units 3C, 3M, and 3Y and respective optical systems in the writing unit 4 are heated beforehand, making it possible to prevent degradation of an image due to dew condensation, without consuming extra power.

By heating the black imaging unit 3K, which is used for the facsimile, during night time and the like, dew condensation does not degrade the black image formed by using the black imaging unit. However, if the room is heated when room temperature is low, e.g., early in the morning, and the room temperature is rapidly raised, dew condensation occurs, degrading the color images. Therefore, the heater for the color imaging units 30*b* is turned ON by using the timer, so that dew condensation hardly occurs at the time of use.

Figures 5A, 5B, 5C:
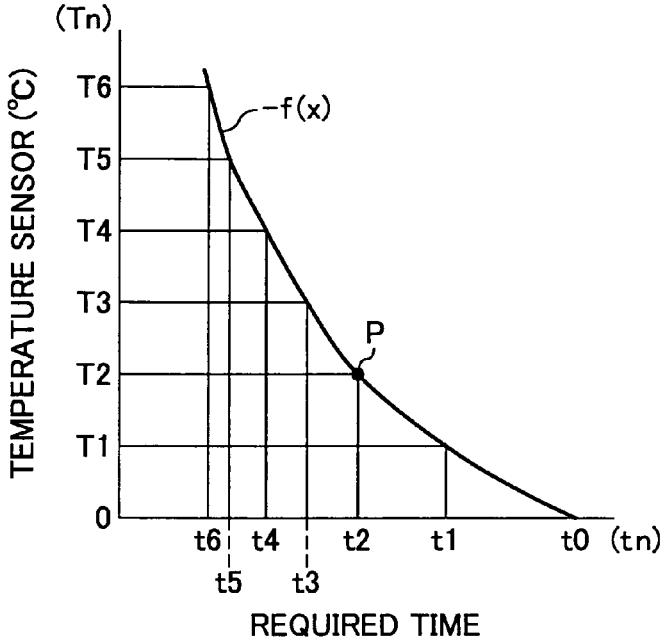
FIG. 5A is a graph of a relation between an outside air temperature and a required time necessary for rising a temperature of an imaging unit to a target value, according to the embodiment.
FIG. 5B is a table containing data of an outside air temperature and a required time, in an associated manner, according to the embodiment.
FIG. 5C is a table containing data of a date and a job start time, in an associated manner, according to the embodiment.

FIG. 5A is a graph of a relation between an outside air temperature and a time required until a temperature of the imaging unit reaches a target value. A temperature Tn detected by the temperature/humidity sensor 41 is plotted on Y axis and a required time tn is plotted on X axis. That is, when the image forming apparatus is installed in a constant temperature bath or the like and the outside air temperature is set to T1, the heater 43 is turned ON to measure the required time to raise a temperature to the target value, and the time at that time is designated as t1. When the outside air temperature is set to T2, the heater 43 is turned ON to measure the required time t2 to raise a temperature to the target value. In this manner, by measuring the required time, when the outside air temperature is sequentially changed up to T6, such characteristic as shown in a graph in FIG. 5A is plotted. For example, when the characteristic forms a quadric curve, the following relational expression can be obtained:

$$f(x)=aX^2+bX+c \quad (1)$$

A measurement is performed in such a condition that the heater 43 is sufficiently cooled to become the same temperature as the outside air temperature before the outside air temperature is changed.

FIG. 5B is a table containing data, in an associated manner, of the outside air temperature and the required time according to the embodiment. For example, in the table shown in FIG. 5B, the outside air temperature detected by the temperature/humidity sensor 41 and the required time until the temperature of the heater 43 reaches the target value are stored in association with each other. In this example, t0 is set in the case of 0 to T1, t1 in the case of T1 to T2, . . . , and by setting a longer time relative to the temperature in each temperature range, the time required for raising a temperature to the target temperature can be ensured. FIG. 5C is a table containing data of a date and a job start time, in an associated manner. In this example, the job start time is set and stored for each date, e.g., on April 2nd, the job start time is 8:00, and on April 3rd, the job start time is 9:30. Not only the date but also the day of the week can be set in the table shown in FIG. 5C.

Figure 6:
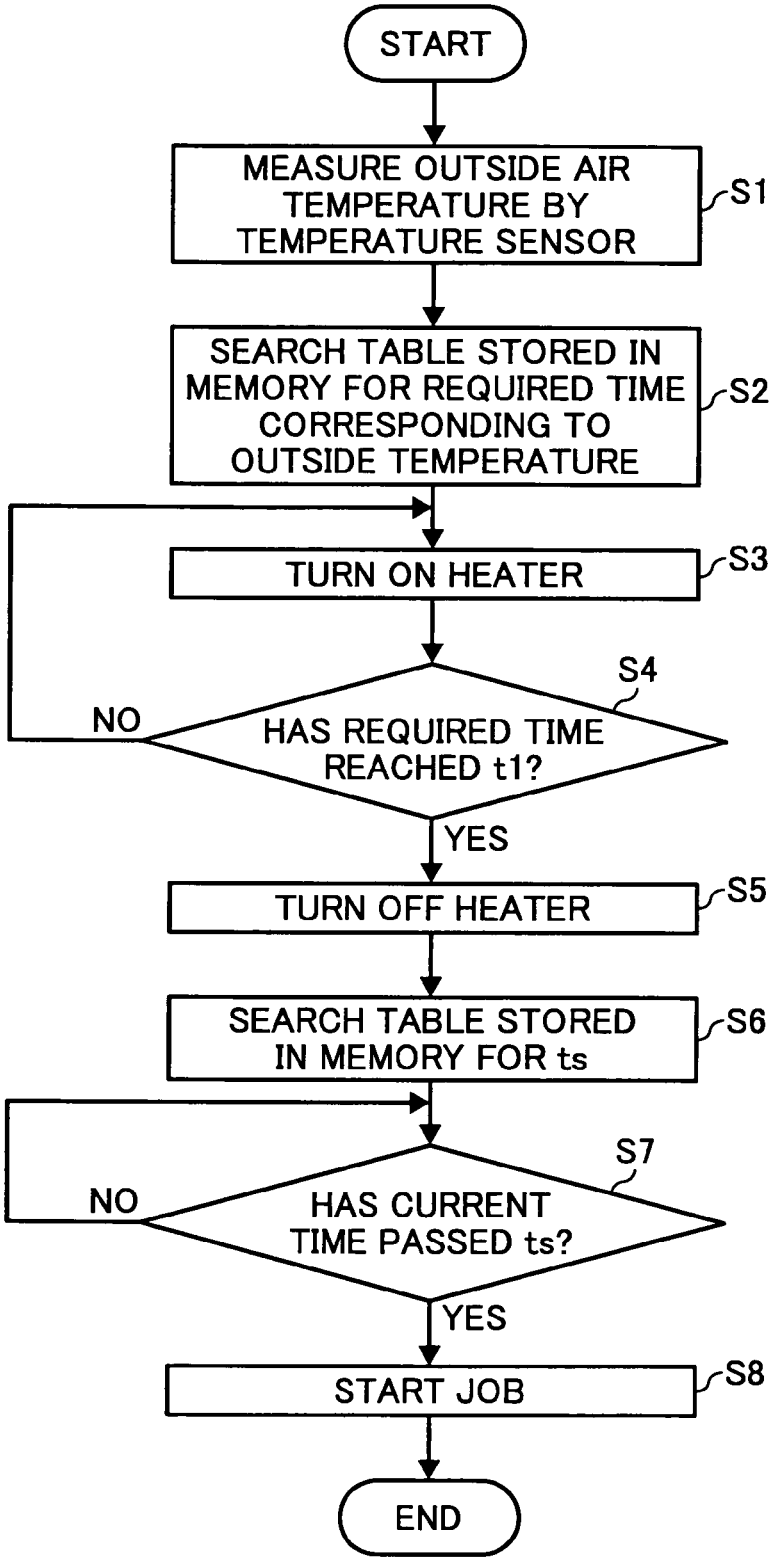
FIG. 6 is a flowchart of a processing procedure of starting a job based on the required time stored in the table shown in FIG. 5B.

FIG. 6 is a flowchart of a processing procedure of starting a job based on the time stored in the table shown in FIG. 5B. The operation is explained with reference to FIGS. 5A to 5C. The outside air temperature is measured by the temperature/humidity sensor 41 (S1). Temperature data is temporarily stored in the memory 44. The table shown in FIG. 5B is searched to search for the required time to raise a temperature to the target temperature (Ts) corresponding to the outside air temperature (S2). For example, when the detected temperature is in the range of T1 to T2, the required time is t1. The heater 43 is turned on (S3) to be a target temperature. The controller 40 monitors whether the required time t1 has elapsed, while counting the timer 42 (S4). If t1 has not elapsed (NO at S4), the heater 43 is continuously operated to be a target temperature. When t1 has been elapsed (YES at S4), the heater 43 is turned OFF (S5). At this point, temperature of an object to be heated reaches the target temperature. Therefore, the table shown in FIG. 5C is searched to search for the job start time on that day (S6). For example, if a day is April 3rd, since the job start time is 9:30, the controller 40 refers to the timer 42 to monitor whether the current time has passed 9:30 (S7). If the current time has passed 9:30 (YES at S7), the job is started (S8).

Figure 7:
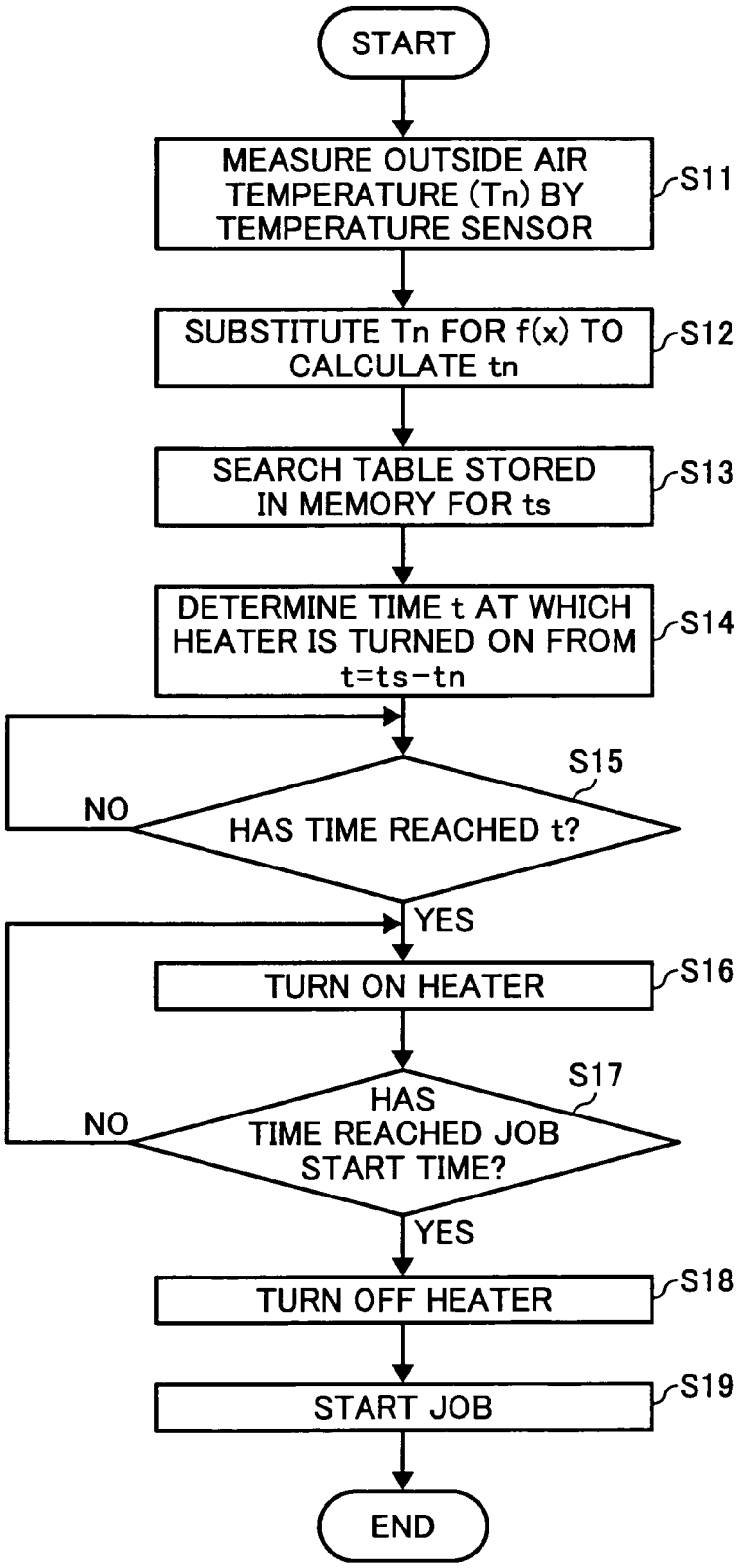
FIG. 7 is a flowchart of a processing procedure of starting a job based on the job start time stored in the table shown in FIG. 5C.

FIG. 7 is a flowchart of a processing procedure of starting a job based on the job start time stored in the table shown in FIG. 5C. The operation is explained with reference to FIGS. 5A to 5C. The outside air temperature Tn is measured by the temperature/humidity sensor 41 (S11). The controller 40 substitutes the outside air temperature Tn for the predetermined relational expression f(x), to calculate the required time tn necessary for rising a temperature to the target temperature (S12). For example, when the outside air temperature is T2, the required time is calculated as t2 as a calculation result. The result is temporarily stored in the memory 44. The table shown in FIG. 5C is searched to search for the job start time on a target day (S13). The time t when the heater 43 is to be turned ON is calculated from t=ts−tn (S14). For example, if the required time tn is 1 hour and the target day is April 3rd, since the job start time is 9:30, the controller 40 determines the time t at which the heater 43, is to be turned ON as t=9:30−1=8:30. The controller monitors whether t has reached 8:30 (S15). When the time comes (YES at S15), the heater 43 is turned ON (S16), until it becomes the job start time (9:30) (S17). When the job start time comes (9:30), the heater 43 is turned OFF (S18), to start job (S19).

By providing a date detecting unit that detects the date in the controller 40, making it possible to set the day on which the heater 30*b* for color imaging units is to be turned ON (or not to be turned ON), power consumption on the holidays can be reduced, and extra power consumption can be reduced by not turning ON the heater 30*b* for color imaging units on the holidays.

Figure 8:
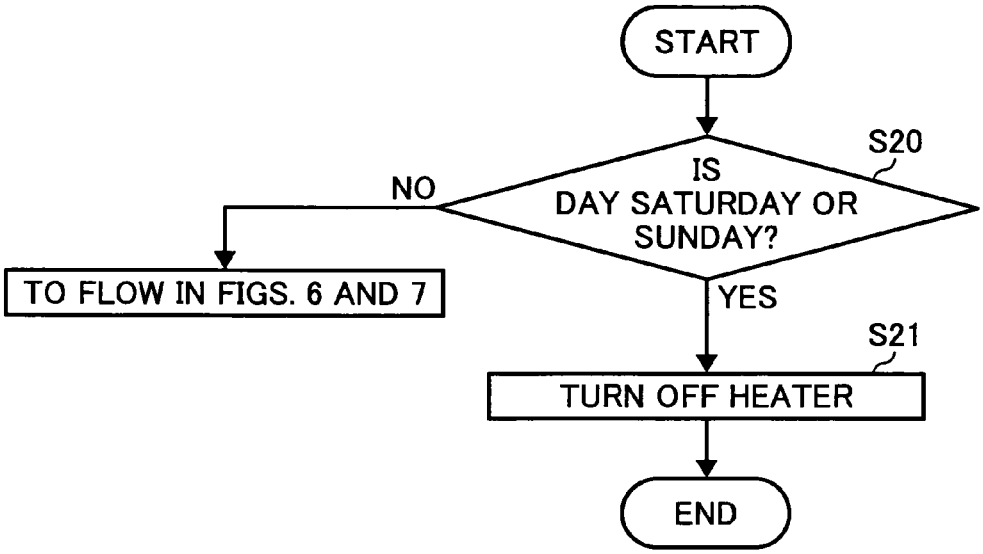
FIG. 8 is a flowchart of a processing procedure of controlling a heater based on a date, according to the embodiment.

FIG. 8 is a flowchart of a processing procedure of controlling a heater based on a date. The controller 40 refers to the timer 42, to search whether the day of the week of the target day is Saturday or Sunday (S20). If the target day is not either Saturday or Sunday (NO at S20), control proceeds to a flow described in connection with FIG. 6 or FIG. 7. If the target day is Saturday or Sunday (including holidays) (YES at S20), the heater is turned OFF (S21).

If the heater is turned ON even when the outside air temperature is high, extra power is necessary. As a countermeasure for the above, the controller 40 includes an outside-air-temperature detecting unit that detects the outside air temperature, and performs a control so that, when the outside air temperature is equal to or higher than a certain temperature, the heaters 30*a* and 30*b* are not turned ON. As a result, the power consumption can be reduced by turning ON the heater exclusively when the heater is necessary for rising a temperature.

If the outside air temperature becomes equal to or lower than a certain temperature, dew condensation on the black imaging unit (the facsimile imaging unit) and the corresponding optical part in the writing unit are hardly prevented by one heater. In this case, the outside-air-temperature detecting unit turns ON the both heaters 30*a* and 30*b*. Accordingly, by turning ON the heaters 30*a* and 30*b* when the outside air temperature becomes equal to or lower than the certain temperature, dew condensation on the black imaging unit and the corresponding optical part in the writing unit can be prevented. When the heater 30*b* for color imaging units is divided for each of the other-color imaging units 3C, 3M, and 3Y, it is effective to operate a divided heater for the other-color imaging unit adjacent to the black imaging unit, i.e., the cyan imaging unit 3C in the example shown in FIG. 1, to generate heat simultaneously with the black imaging unit 3K.

Figure 9:
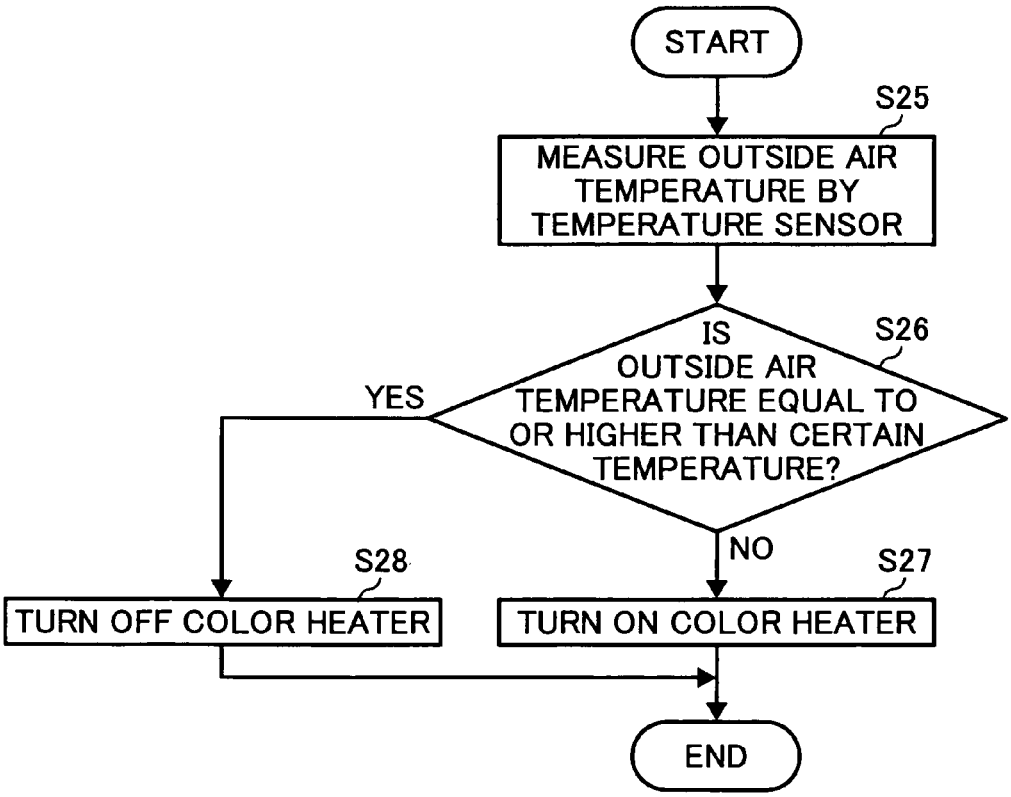
FIG. 9 is a flowchart of a processing procedure of controlling a heater based on an outside air temperature, according to the embodiment.

FIG. 9 is a flowchart of a processing procedure of controlling a heater based on an outside air temperature. The controller 40 measures the outside air temperature by the temperature/humidity sensor 41 (S25). As a result, when the outside air temperature is equal to or higher than a certain temperature (YES at S26), the color heater is turned OFF (S28). When the outside air temperature is lower than the certain temperature (NO at S26), the color heater is turned ON (S27). The color heater can be controlled by detecting not only the temperature but also the humidity.

If the heater is turned ON, although the outside air humidity is low, extra power needs to be consumed.

To prevent the extra power consumption, the controller 40 includes an outside air humidity sensor that detects the outside air humidity (not shown), and is configured in such a manner that, when the outside air humidity is equal to or lower than certain humidity, the heaters 30*a* and 30*b* are not turned ON. Accordingly, exclusively when the humidity is at a certain level, the heater is turned ON. As a result, it is possible to realize reduction of the power consumption.

When the outside air humidity becomes equal to or higher than the certain humidity, there is often a case that one heater is not sufficient for preventing an occurrence of dew condensation on the black imaging unit. As a measure for the above, an outside-air-humidity detecting unit is formed in such a manner that the both heaters 30*a* and 30*b* are turned ON when the outside air humidity becomes equal to or higher than the certain humidity. Accordingly, since the both heaters 30*a* and 30*b* are turned ON when the outside air humidity becomes equal to or higher than the certain humidity, dew condensation on the black imaging unit can be prevented more reliably.

With regard to fitting of the dew-condensation preventing device 30, if the sheet metal 35 is provided around the imaging units and the writing unit (at appropriate positions along a moving direction of the imaging units), and the dew-condensation preventing device 30 is fitted to the sheet metal 35, excellent heat conduction can be achieved.

In the embodiment shown in connection with FIGS. 3 and 4, the sheet metal 35 for separating the paper feeder 2 and the writing unit 4 is provided approximately horizontally below the writing unit 4 corresponding to the respective imaging units, and the heaters 30*a* and 30*b* constituting the dew-condensation preventing device 30 are fitted to the sheet metal 35, so that turning ON/OFF of each of the heaters 30*a* and 30*b* can be controlled individually. Thus, by providing the sheet metal 35 having excellent heat conduction below the writing unit 4, and by fitting the dew-condensation preventing device 30 to the sheet metal 35, the heat generated by respective heaters can be efficiently conducted to the optical parts in the writing unit and respective imaging units.

Figure 10:
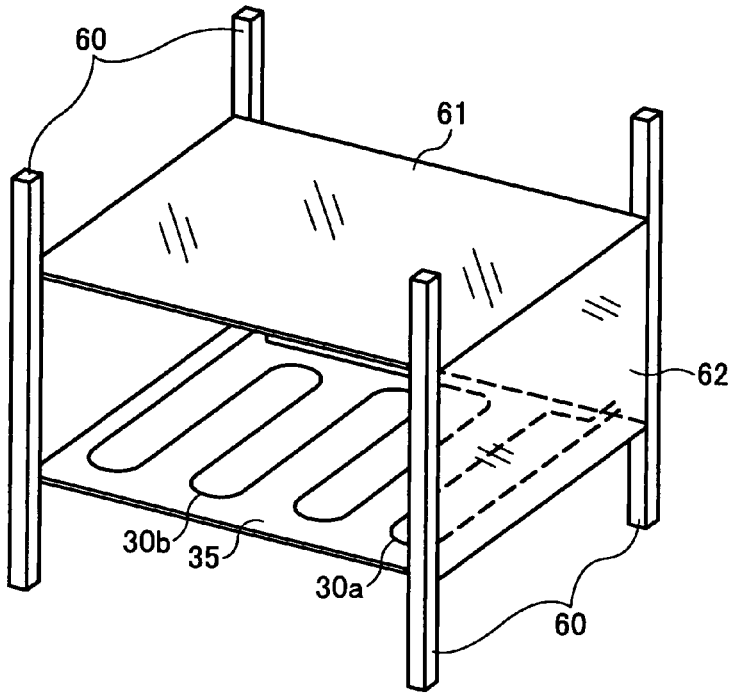
FIG. 10 is a schematic diagram of relevant parts of a housing structure of a body of the image forming apparatus shown in FIG. 1.

FIG. 10 is a schematic diagram of relevant parts of a housing structure of the apparatus body 1 of the image forming apparatus A, where the sheet metal 35 mounted with the dew-condensation preventing device 30 is fixed inside of supporting member 60 provided at four corners, and a partition plate 61 is arranged above the sheet metal 35 with a predetermined interval. A sheet metal 62 constituting a side wall is arranged at least on one side of a space above the sheet metal 35. In the configuration example shown in FIG. 3, the writing unit 4 is arranged in the space above the sheet metal 35, and the respective imaging units 3C, 3M, 3Y, and 3K (the image forming unit B) are mounted on the partition plate 61.

The heat generated from each of the heaters 30*a* and 30*b* constituting the dew-condensation preventing device 30 is conducted to the partition plate 61 from the sheet metal 35 through the sheet metal 62 constituting the side wall, and heats the respective imaging units 3C, 3M, 3Y, and 3K. Furthermore, because the heat from the heaters is directly conducted to the writing units for the respective imaging units 3C, 3M, 3Y, and 3K, which constitute the writing unit 4 and is arranged immediately above the dew-condensation preventing device 30, the internal parts are heated via a casing. Accordingly, dew condensation on the optical parts can be prevented.

In a general housing configuration, since four sides of the space above the sheet metal 35 is surrounded by sheet-metal side plates, the heat from the dew-condensation preventing device 30 is efficiently conducted to the writing unit 4 and the respective imaging units positioned above, through these side plates.

Figure 11:
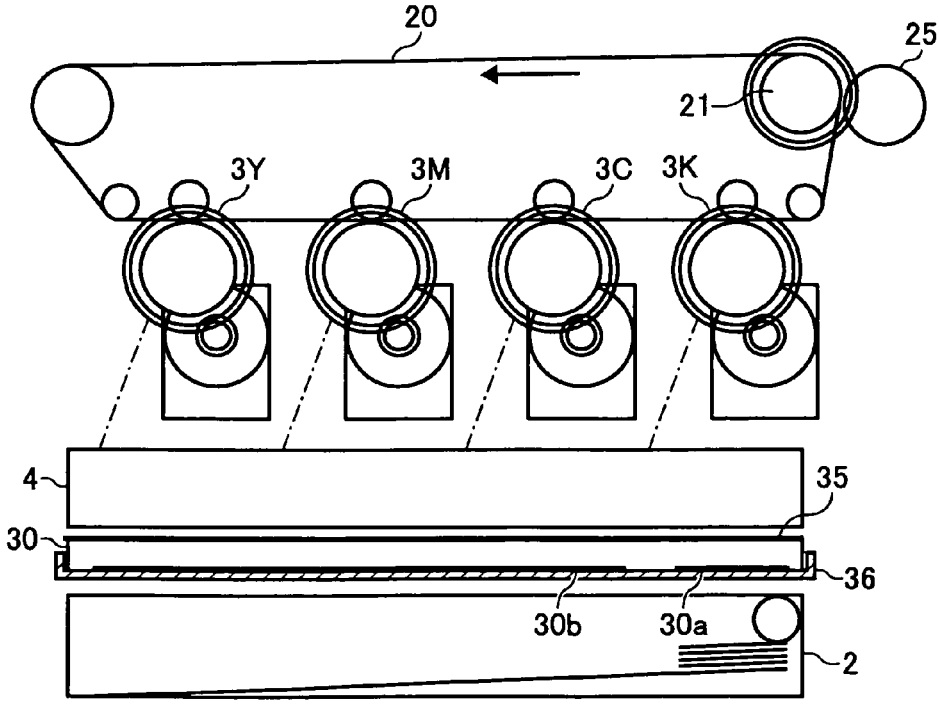
FIG. 11 is a schematic diagram of an example of a sheet metal on which a dew-condensation preventing device is arranged, according to the embodiment.

As shown in FIG. 11, the configuration can be such that directions other than the sheet metal 35 (directions other than the imaging units) are surrounded by shielding members 36 (such as a mold or a heat insulator) having a heat conductivity lower than a metal, so that the heat generated by each of the heaters 30*a* and 30*b* is efficiently conducted to the respective imaging units and the writing unit. In this configuration, the heat from the heaters can be prevented from being released to other directions, thereby enabling efficient heat conduction to the respective imaging units and the writing unit.

Figure 12:
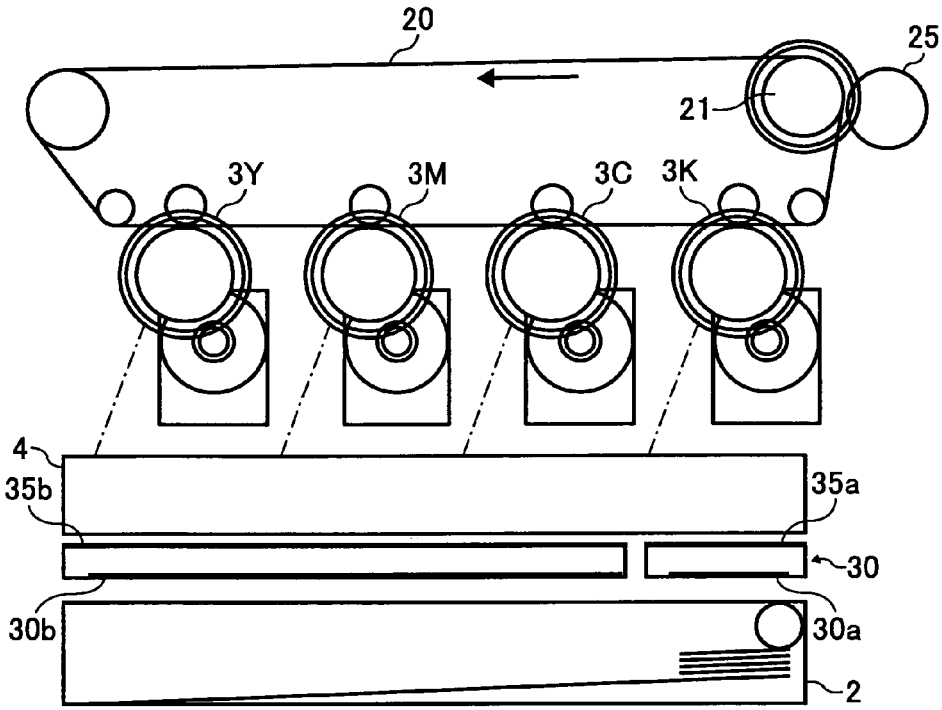
FIG. 12 is a schematic diagram of another example of the sheet metal shown in FIG. 11.

FIG. 12 is a schematic diagram of the sheet metal for fitting the dew-condensation preventing device 30, which is divided and arranged, in which the sheet metal 35 is divided into a sheet metal 35*a* for fitting the heater for the black imaging unit, and a sheet metal 35*b* for fitting the heater for the color imaging units (separated so that mutual heat conduction is intercepted).

By dividing the heater as well as the sheet metal 35 into a plurality of sections corresponding to the respective imaging units, the black imaging unit can be heated more effectively, without releasing the heat of the heater 30*a* for the black imaging unit toward other imaging units.

To heat the black imaging unit (the facsimile imaging unit) more effectively without releasing the heat from the heater 30*a* for the black imaging unit to other directions, the divided heaters 30*a* and 30*b* are respectively fitted to the separated sheet metals 35*a* and 35*b*. By forming the sheet metal 35*a* for fitting the heater for the black imaging unit and the sheet metal 35*b* for fitting the heater for the color imaging units as separated bodies, the black imaging unit can be heated more efficiently.

Alternatively, the sheet metal 35*b* for fitting the heater for the color imaging units can be divided for each of the imaging units 3C, 3M, and 3Y, so that heat conduction is intercepted between each of divided sheet metals.

Figure 13:
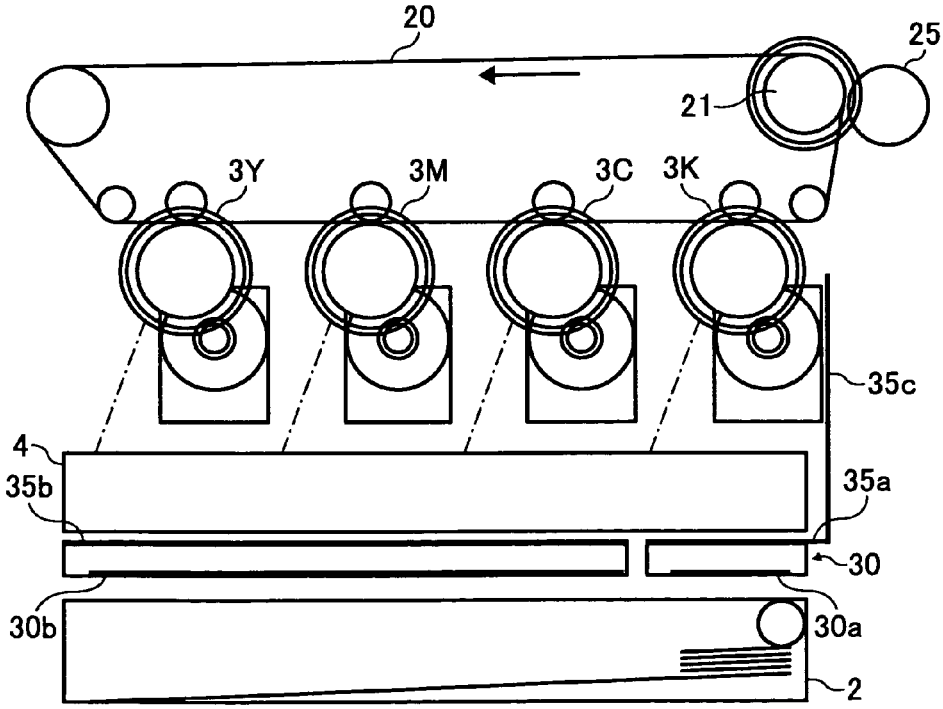
FIG. 13 is a schematic diagram of still another example of the sheet metal shown in FIG. 11.

FIG. 13 is a schematic diagram of the sheet metal for fitting the dew-condensation preventing device having a heatsink member. If a heatsink member 35*c*, such as a radiating fin, is attached to the sheet metal 35 for fitting the heater, more heat can be conducted to the imaging units.

In an embodiment shown in FIG. 13, the heatsink member 35*c* is arranged on the sheet metal 35*a* to which the black imaging unit is fitted, to conduct the heat from the dew-condensation preventing heater to the imaging unit and the writing unit more effectively. Alternatively, the heatsink member 35*c* can be arranged to the sheet metal 35*b* for fitting the heater for the color imaging units or an integral fitting sheet metal.

The number of parts can be reduced by forming the heater pipes divided for each of the imaging units 3C, 3M, and 3Y other than the black as an integral heater 30*b* as shown in FIG. 12. Furthermore, in FIG. 12, although a thermostat is omitted, the configuration can be such that the heater temperature is kept constant by the thermostat.

When a part of the heaters is exclusively turned ON, not only the black imaging unit but also other-color imaging units can be heated (turned ON).

The heater can have a configuration in which either the imaging unit or the writing unit, or both are heated.

Furthermore, as for the color used in the imaging unit, "other colors" can be a monochrome color or a plurality of colors (multi-colors).

In the image forming apparatus including the dew-condensation preventing unit according to the present invention, since the heater for heating the black imaging unit and the corresponding optical parts in the writing unit, and the heater for heating the color imaging units other than the black and the corresponding optical parts in the writing unit can be controlled separately, the power consumption for heating the imaging units and the writing unit, which are not used during night time and holidays, can be reduced.

According to an aspect of the present invention, during a period having high operation frequency of a facsimile machine, such as during night time and holidays, extra power consumption during night time and holidays can be avoided, by setting that a monochrome imaging unit (the photoconductor and the writing unit) is exclusively heated. That is, the heater for heating the monochrome imaging unit (the photoconductor and the writing unit) and the heater for heating the color imaging units are separately controlled, so that the power consumption for heating the color imaging units, which are not used during night time and holidays, can be reduced.

When a part of the heaters is exclusively turned ON, not only the black imaging unit but also other-color imaging units can be heated (turned ON).

Furthermore, the heater can have a configuration in which either the imaging unit or the writing unit, or both are heated.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a plurality of writing units, each of the writing units configured to write an optical image on a corresponding one of an image carrier;

a plurality of image forming units, each of the image forming units configured to develop an optical image on a corresponding one of the image carrier to a visible image in a corresponding color;

a plurality of heaters configured to heat one or more of the image forming units and the writing units to prevent occurrence of dew condensation;

a control unit configured to perform ON/OFF control of each of the heaters; and a date detecting unit that detects a date, wherein the control unit controls ON/OFF of the heaters based on the date detected by the date detecting unit.

2. An image forming apparatus, comprising:

a plurality of writing units, each of the writing units configured to write an optical image on a corresponding one of an image carrier;

a plurality of image forming units, each of the image forming units configured to develop an optical image on a corresponding one of the image carrier to a visible image in a corresponding color;

a plurality of heaters configured to heat one or more of the image forming units and the writing units to prevent occurrence of dew condensation;

a control unit configured to perform ON/OFF control of each of the heaters; and a date detecting unit that detects a date, wherein the heaters include a first heater configured to heat one of the image forming units and corresponding one of the writing units; and a second heater configured to heat the image forming units and the writing units other than the image forming unit and the writing unit heated by the first heater, and the control unit separately perform ON/OFF control of each of the first heater and the second heater, and the control unit controls ON/OFF of the heaters based on the date detected by the date detecting unit.

3. The image forming apparatus according to claim 2, wherein the image forming apparatus is a multifunction product including a facsimile mechanism, and the first heater configured to heat an image forming unit and a writing unit corresponding to black color.

4. The image forming apparatus according to claim 2, further comprising a fixing unit having a fixing heater to fix a visible image on a recording medium, wherein the control unit turns ON the first heater when a predetermined time elapsed after the fixing heater is shifted to an energy saving mode.

5. The image forming apparatus according to claim 2, further comprising a time detecting unit that detects a target time necessary for controlling ON/OFF of the heaters, wherein the control unit controls a start of a job based on the target time.

6. The image forming apparatus according to claim 2, further comprising a temperature detecting unit that detects an outside air temperature, wherein when the outside air temperature is equal to or higher than a predetermined temperature, the control unit controls the heaters not to be turned ON.

7. The image forming apparatus according to claim 6, further comprising a fixing unit having a fixing heater to fix a visible image on a recording medium, wherein when the outside air temperature is equal to or lower than a predetermined temperature, the control unit controls the heaters to be turned ON when a predetermined time elapsed after the fixing heater is shifted to the energy saving mode.

8. The image forming apparatus according to claim 2, further comprising a humidity detecting unit that detects an outside air humidity, wherein when the outside air humidity is equal to or higher than a predetermined humidity, the control unit controls the heaters not to be turned ON.

9. The image forming apparatus according to claim 8, further comprising a fixing unit having a fixing heater to fix a visible image on a recording medium, wherein when the outside air humidity is equal to or lower than a predetermined humidity, the control unit controls the heaters to be turned ON when a predetermined time elapsed after the fixing heater is shifted to the energy saving mode.

10. The image forming apparatus according to claim 2, further comprising:

a temperature detecting unit that detects an outside air temperature; and a storage unit that stores therein a first table containing information on the outside air temperature and a required time necessary for rising a temperature of the image forming units to a target temperature, in an associated manner; and a second table containing information on a date and a job start time, in an associated manner, wherein the control unit searches the first table for the required time based on the outside air temperature detected by the temperature detecting unit, runs the heaters during the required time, searches the second table for the job start time, and starts a job at the job start time.

11. The image forming apparatus according to claim 2, further comprising:

a temperature detecting unit that detects an outside air temperature Tn; and a storage unit that stores therein a first table containing information on Tn and a required time tn necessary for rising a temperature of the image forming units to a target temperature, in an associated manner; and a second table containing information on a date and a job start time ts, in an associated manner, wherein the control unit obtains tn at the time of Tn, searches the second table for ts, obtains a time t at which the heaters are turned ON from t=ts-tn, turns ON the heaters at the time of t, turns OFF the heaters and starts a job at the time of ts.

12. The image forming apparatus according to claim 11, further comprising a sheet-shaped metallic member arranged between each of the image forming units and the corresponding writing units, wherein the image forming units face the corresponding writing units, and the heaters are fitted to the sheet-shaped metallic member.

13. The image forming apparatus according to claim 2, further comprising a sheet-shaped metallic member arranged right under the writing units, wherein the writing units are arranged below the corresponding image forming units, and the heaters are fitted to the sheet-shaped metallic member.

14. The image forming apparatus according to claim 13, wherein the sheet-shaped metallic member is provided at one of positions along a rotation direction of each of the image forming units.

15. The image forming apparatus according to claim 14, wherein each of surrounding areas, where the sheet-shaped metallic member is not arranged, for each of the image forming units are surrounded by a mold.

16. The image forming apparatus according to claim 14, wherein each of surrounding areas, where the sheet-shaped metallic member is not arranged, for each of the image forming units are surrounded by a heat shielding member.

17. The image forming apparatus according to claim 13, wherein each of the first heater and the second heater is installed on each different sheet-shaped metallic member.

18. The image forming apparatus according to claim 13, further comprising a heatsink member arranged on the sheet-shaped metallic member, wherein the heatsink member conducts heat from the heaters.

19. The image forming apparatus according to claim 2, wherein the first heater and the second heater are integrally formed as a single heater.

* * * * *